United States Patent [19]

Schwartz

[11] Patent Number: 4,491,437

[45] Date of Patent: Jan. 1, 1985

[54] CONNECTOR FOR GEODESIC DOME

[76] Inventor: Victor M. Schwartz, 2020 Dwight Way, Apt. C, Berkeley, Calif. 94704

[21] Appl. No.: 353,201

[22] Filed: Mar. 1, 1982

[51] Int. Cl.[3] ..... E04B 1/32

[52] U.S. Cl. ..... 403/172; 52/81; 52/648; 403/176

[58] Field of Search ..... 52/80, 81, 86, 648; 403/172, 175, 176

[56] References Cited

U.S. PATENT DOCUMENTS

| | | | |
|---|---|---|---|
| 2,583,474 | 1/1952 | Cozzone | 403/175 |
| 2,682,235 | 6/1954 | Fuller . | |
| 2,914,074 | 11/1959 | Fuller . | |
| 3,002,590 | 10/1961 | Hannoosh et al. . | |
| 3,105,969 | 10/1963 | Banche | 52/81 |
| 3,114,176 | 12/1963 | Miller . | |
| 3,137,371 | 6/1964 | Nye . | |
| 3,186,522 | 6/1965 | McCauley . | |
| 3,192,669 | 7/1965 | Hawkins | 52/81 |
| 3,323,820 | 6/1967 | Braccini . | |
| 3,486,278 | 12/1969 | Woods . | |
| 3,635,509 | 1/1972 | Birkemeier et al. . | |
| 3,810,342 | 5/1974 | Scott . | |
| 3,844,074 | 10/1974 | Ahern . | |
| 3,844,664 | 10/1974 | Hogan . | |
| 3,990,195 | 11/1976 | Gunther . | |
| 4,260,276 | 4/1981 | Phillips | 52/80 |
| 4,262,461 | 4/1981 | Johnson et al. . | |
| 4,370,073 | 1/1983 | Ohme | 403/172 |
| 4,379,649 | 4/1983 | Phillips | 403/172 |
| 4,395,154 | 7/1983 | Phillips | 403/172 |
| 4,432,661 | 2/1984 | Phillips | 403/172 |

FOREIGN PATENT DOCUMENTS

| | | | |
|---|---|---|---|
| 155041 | 6/1956 | Sweden | 403/175 |

OTHER PUBLICATIONS

Louden Dairy Barn Fittings, Plate 5 received Jun. 25, 1915.

Geodesics by Edward Popko, ©1968 by U. of Detroit Press, Fig. 69–78.

*Raumliche Tragwerke aus Stahl,* ©1963 by Verlag Stahleisen.

Timberline Geodesics, The Catalog for Geodesic Dome Kits and Plans, 1981 Timberline Geodesics, Berkeley, CA, Victor M. Schwartz, Vice-President.

*Primary Examiner*—Henry E. Raduazo

*Attorney, Agent, or Firm*—James R. Cypher

[57] ABSTRACT

A metal connector for a geodesic dome structure constructed with wood struts. The connector including a cylindrical hub with metal support arms welded to the outer surface of the hub and extending outwardly in spaced pairs. The arms are formed with openings for receiving bolts which register with bolt openings in the wood struts.

In a modified form of the invention, the hubs are formed with internal threads which threadably receive a metal pipe. A second metal connector may be threadably joined to the metal pipe; thereby spacing the connectors for constructing dormers, cupolas doorways, double domes and other peripheral and interior structures.

3 Claims, 19 Drawing Figures

CONNECTOR FOR GEODESIC DOME

BACKGROUND OF THE INVENTION

The dome as a building technique was first found in the tombs of the Mesara Plain in Crete (c. 2500–2000 BC). The Pantheon at Rome (c. AD 112) however, is the first important example of a dome. It provided the inspiration for a whole series of circular churches, large and small with domes or vaults, from the Renaissance onwards. These early domes were constructed from stone and were massive structures.

The dome as a building technique was revived in the late nineteen thirties by Buckminster Fuller who began to create a variety of novel connections to create his now famous geodesic domes. Examples of patented Fuller geodesic domes are U.S. Pat. Nos. 2,682,235 and 2,914,074.

Fuller, as well as the Romans and other early dome builders were successful in creating huge open spaces but gave no thought to developing a universal connector which would not only create the roof structure but also serve as a connector for attaching other structures above or below the roof line.

Many other connectors for geodesic domes have been presented but all are concerned with the single purpose of creating the shell. None of them make any provision for appurtenant structures which attach to either the outside or inside of the dome structure.

Hannoosh, U.S. Pat. No. 3,002,590 provides a ring connector for the attachment of straps but no connection is provided radial to the dome surface.

Miller, U.S. Pat. No. 3,114,176 illustrates a wood geodesic dome which was popular in the nineteen sixties and is still in vogue today. Miller did not use metal connectors and shows no means of attaching structural members radial to the dome at the intersection of the wood struts.

Nye, U.S. Pat. No. 3,137,371 teaches a disc type metal connector for attaching wood struts. No provision is made for connecting struts radial to the dome.

McCauley, U.S. Pat. No. 3,186,522 teaches clips to hold wood struts but does not provide any space in the center of the cluster of clips to insert pipes or other structural members through the center of the hub. Other than the pipe 28 which is part of the hub structure. No structure is provided for connecting another connector radial to the dome.

Braccini, U.S. Pat. No. 3,323,820 teaches a ring connector with provision for the attachment of specially notched wood struts. There is no substantial opening through the connector for the insertions of pipes nor does the connector teach a structure for connecting members radial to the dome.

Woods, U.S. Pat. No. 3,486,278 teaches the use of a cylindrical hub member in which individual clamps attach wood strut members to the hub. The struts cannot abut the hub for compression strength nor is there any provision for attaching members radial to the dome.

Birkemeir, U.S. Pat. No. 3,635,509 teaches a cylindrical hub with cresent shaped bolt holds welded to the inner hub wall and stiffener plates welded to the top and bottom of the hub. No opening is provided through the hub except for a small opening used as a lifting attachment during construction of the dome. No provision is made for attachment of structural members radial to the dome.

Scott, U.S. Pat. No. 3,810,342 teaches a hexagonal hub with bolt openings therethrough for the receipt of bolts attached to connector assemblies which hold the wood struts. A stiffening plate adds rigidity thereby preventing insertion of structural members through the hub. No provision is made for attachment of members radial to the dome.

Ahern, U.S. Pat. No. 3,844,074 provides a cone shaped hub to which diverging leg members are bolted. No opening is provided for relatively large structures to protrude therethrough and there is no provision for structures to be attached radial to the dome.

Hogan, U.S. Pat. No. 3,844,664 teaches an icolsahedron disc for attaching wood struts. There is no substantial opening through the disc or any provision for attachment of structures radial to the dome.

Gunther, U.S. Pat. No. 3,990,195, teaches a connector having leg plates welded together which are inserted through slits made in the end of the wood struts. No substantial opening is provided through the connector nor is there any provision for connecting structural members radial to the dome.

Johnson et al., U.S. Pat. No. 4,262,461 teaches the use of a sleeve formed with openings for the receipt of specially formed tongue members. The wood struts are attached to the tongue members. No provision is made for the attachment of structural members radial to the dome.

SUMMARY OF THE INVENTION

The present invention provides a metal connector for attaching wood struts in a geodesic dome in which the connector is fabricated with support arms welded at pre-set axial and radial angles.

An object is to provide connectors which enable the framework of a geodesic dome to be easily and quickly assembled.

Another object is to provide a heavy-duty connector for large compression loads in the struts and which nearly eliminates the shear in the strut bolts due to compression loads.

A further object is to provide a connector which permits the insertion of structural members therethrough.

Still another object is to provide a connector which may be easily modified to provide a structural connection for members radial to the dome.

A still further object is to provide a connector in which structural wood members may be attached at angles other than radial to the connector hub.

Another object is to provide a connector which will accommodate all nominal 2" struts from 2×4's up to and including 2×14" without any modification of the structure of the connector. The heavier struts may be used wherever they are structurally required within the dome. This is especially useful for the installation of sky lights and framing dormers and doorways.

DESCRIPTION OF THE PREFERRED EMBODIMENTS

Figure 1:
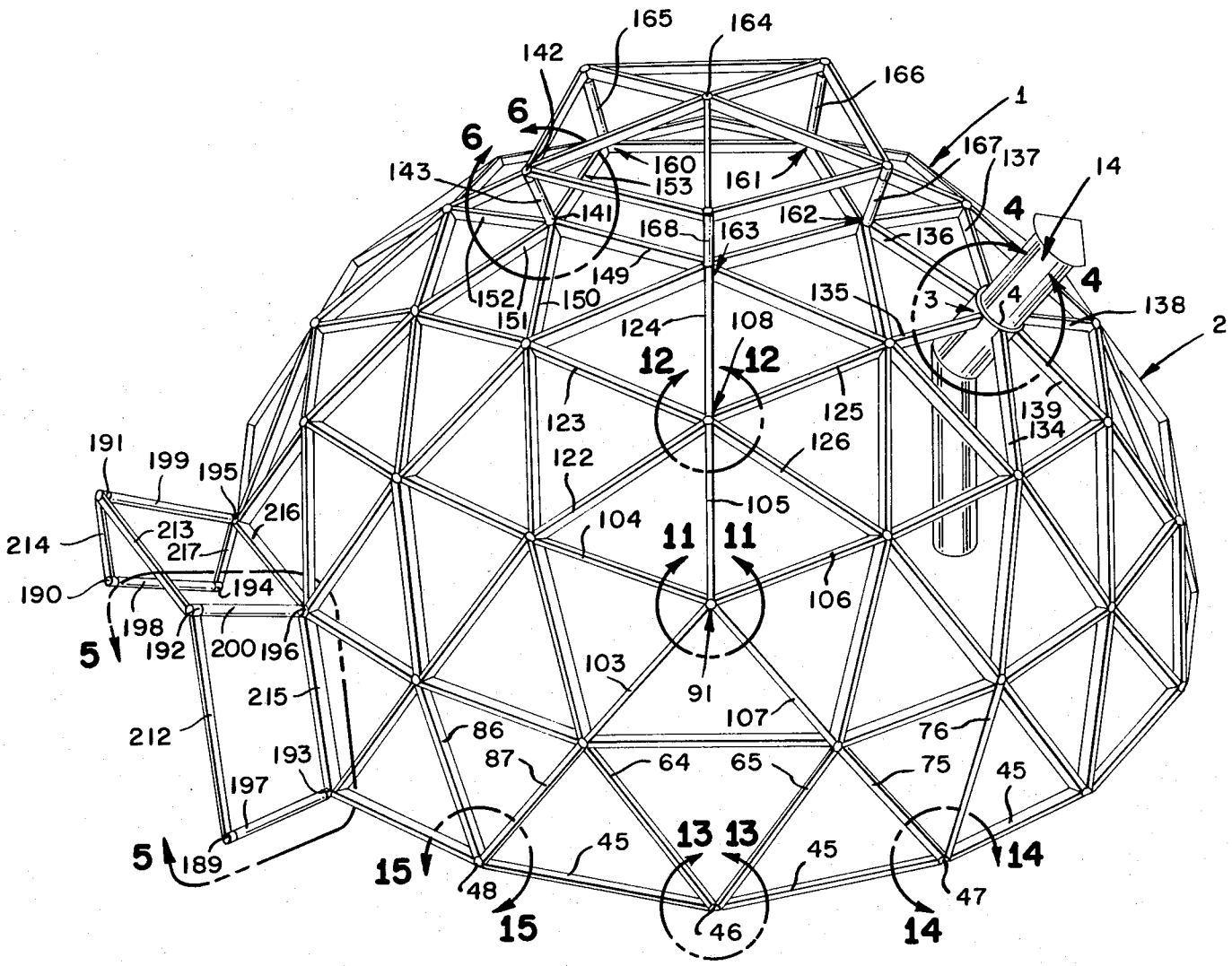
FIG. 1 is a perspective view of a primary application of the connector of the present invention. No connectors are illustrated. Reference numbers corresponding to connectors refer only to location of the respective connectors.

Referring to FIG. 1 a single geodesic dome 1 is shown which consists of a plurality of wood strut members 2 joined at their intersections by metal connectors 3. All of the metal connectors 3 consist of basically the same elements but have different configurations and dimensions as illustrated in FIGS. 11-19.

Figure 11:
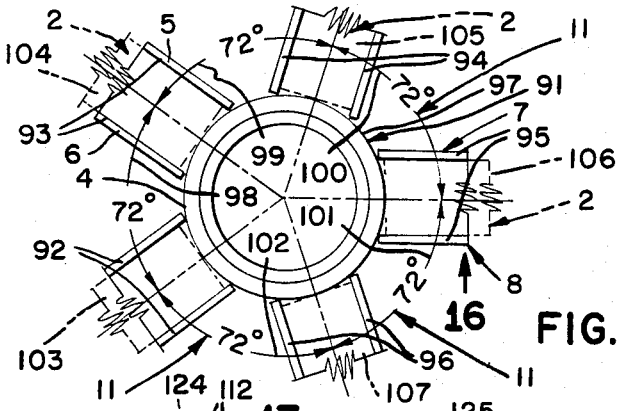
FIG. 11 is a plan view of a portion of the connector shown generally within line 11—11 of FIG. 1.
Figure 16:
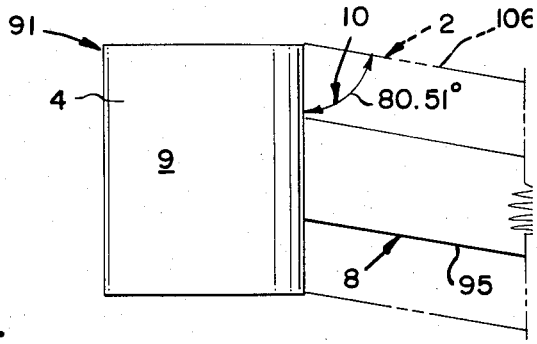
FIG. 16 is a side view of a portion of the connector as indicated generally by the arrow 16 in FIG. 11.
Figure 17:
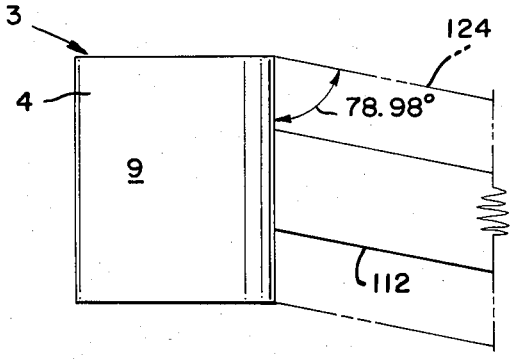
FIG. 17 is a side view of a portion of the connector as indicated generally by the arrows 17 in FIG. 12.
Figure 18:
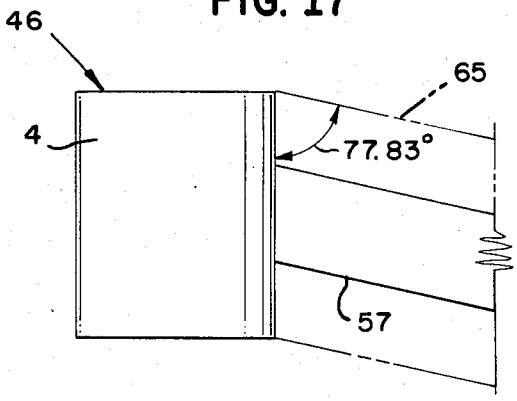
FIG. 18 is a side view of a portion of the connector as indicated generally by the arrow 18 in FIG. 13.
Figure 19:
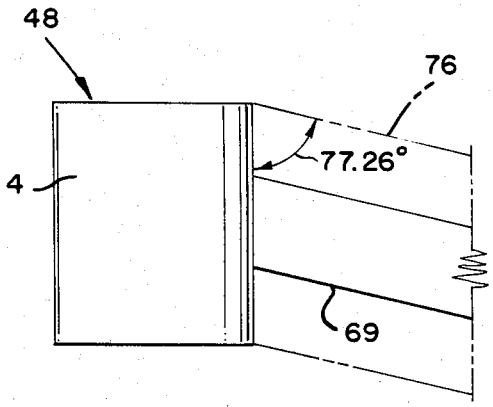
FIG. 19 is a side view of a portion of the connector as indicated generally by the arrow 19 in FIG. 14.

Generally, the metal connectors 3 (See FIG. 4) consists of a hub member 4 and at least two pairs of circumferentially spaced support arms 5-8. The arms are attached to the hub by welding their inner ends to the outside wall 9 of the hub. The pairs of arms extend radially outwardly from the hub and parallel to one another at pre-selected axial angles 10 and radial angles 11 as generally indicated in FIGS. 11 and 16. The arms are formed with at least two pairs of radially spaced and aligned bolt openings 12 adapted for the receipt of wood structural members 2 therebetween and joined to the arms by fastening means 13 registering in the bolt openings 12 and bore holes in the wood structural members.

Preferably the hub member 4 is tubular in shape. For the non-threaded hubs, however, the hub could be polygonal in cross section.

The connector is designed so that it is not necessary to cut the ends of the struts at an angle thereby reducing the number of cuts necessary to fabricate the structure. Additional compression forces, however, may be achieved if the ends of the wood structural member are cut at an angle and abut the peripheral wall of the hub.

The tubular hub 4 is dimensioned so as to generate a peripheral surface capable of receiving at least five wood structural members 2 of two inch nominal size in end abutting relation.

Figure 4:
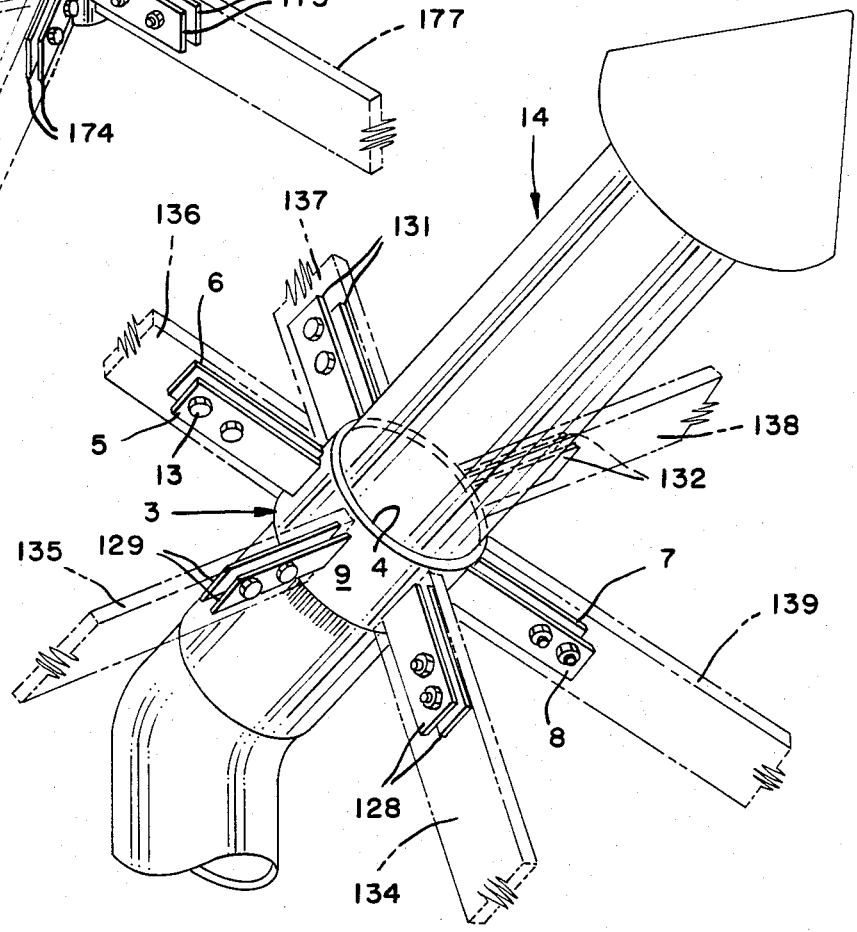
FIG. 4 is an enlarged perspective view of the connector of the present invention taken generally within the portion of the dome indicated by the lines 4—4 of FIG. 1.

In a modified form of the invention shown in FIGS. 1 and 4, the tubular hub 4 has a larger diameter so that it can receive a tubular pipe 14 therethrough. This could vary from a small vent pipe or electrical conduit up to smoke stakes for stoves or furnaces.

Figure 7:
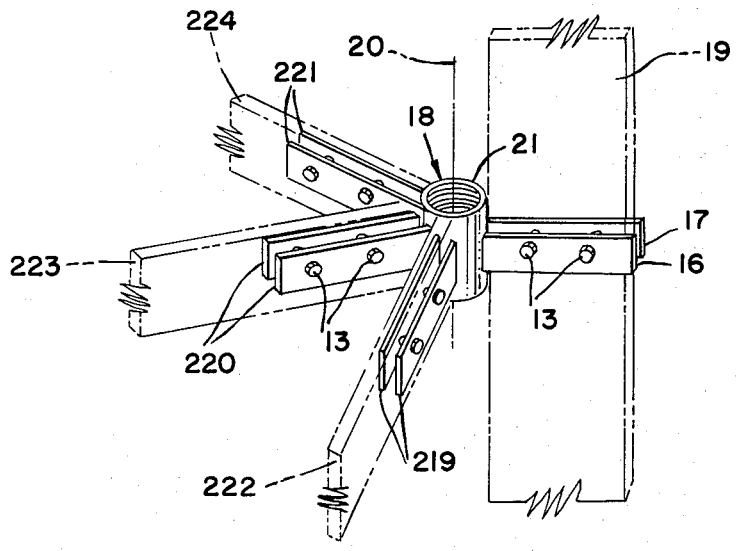
FIG. 7 is a perspective view of a modified form of the connector holding frame members shown in phantom line.

FIG. 7 illustrates the versatility of the metal connector of the present invention. The support arms 16 and 17 of modified connector 18 have a length dimensioned to receive and hold structural member 19 parallel to the axis 20 of the hub 21. The hub may be formed with pairs of arms 219-221 which hold struts 222-224 in the usual manner.

Figure 3:
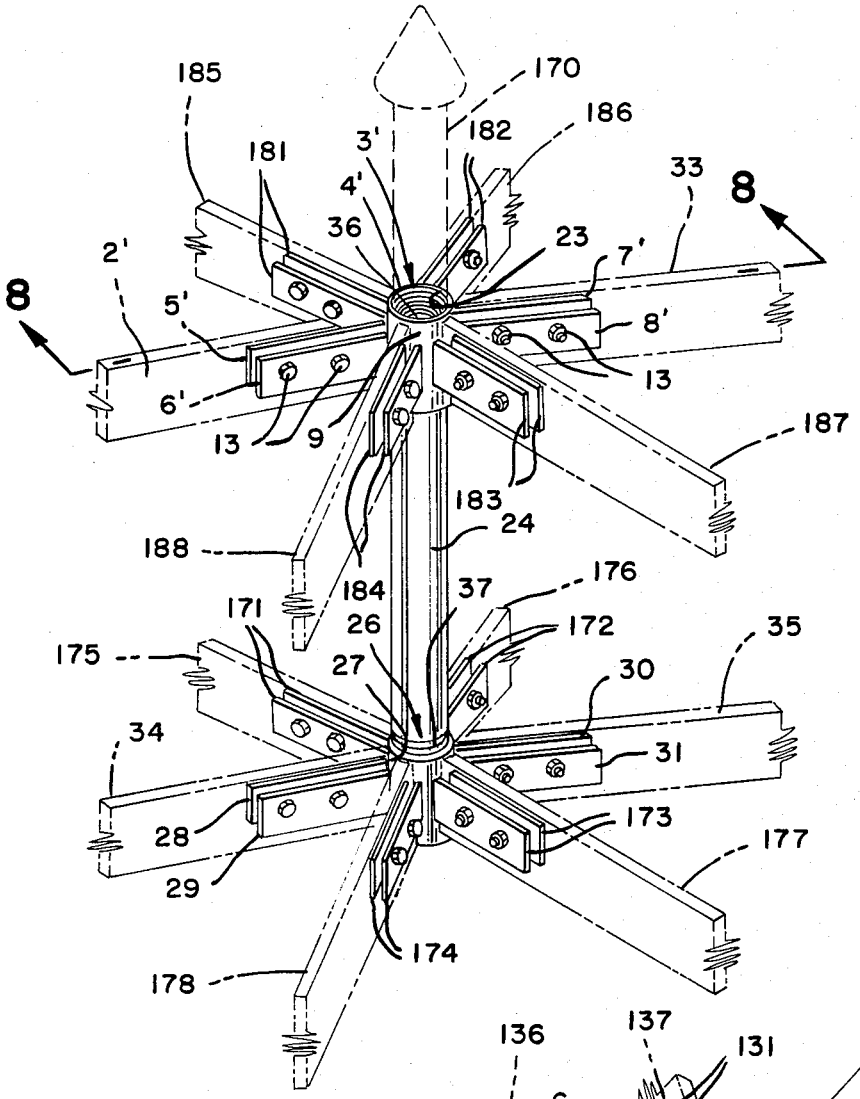
FIG. 3 is an enlarged perspective view of the connector of the present invention taken generally within the portions of the dome indicated by the lines 3—3 of FIG. 2.
Figure 8:
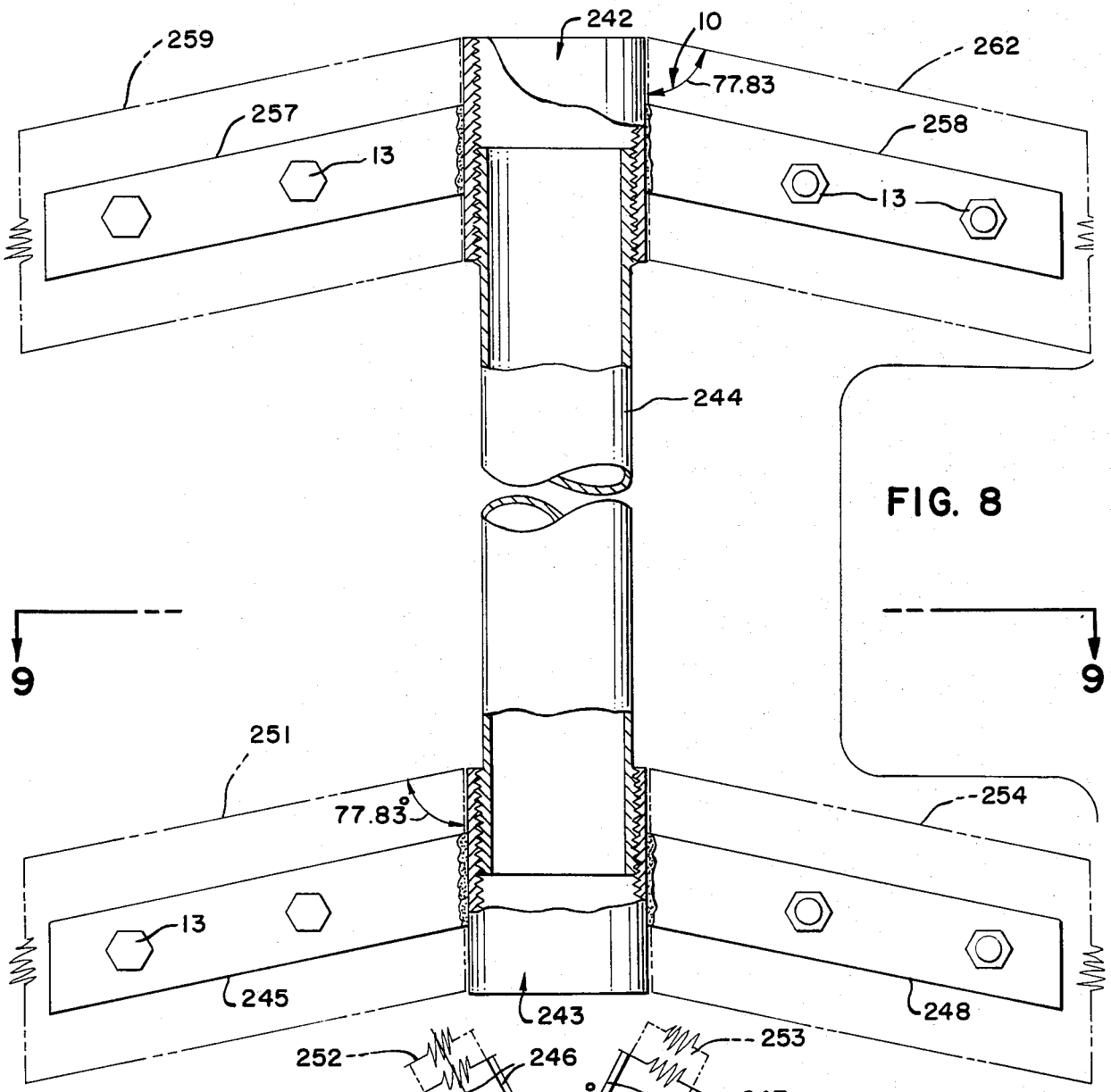
FIG. 8 is an enlarged cross sectional view of the connector taken along line 8—8 of FIG. 2.
Figure 9:
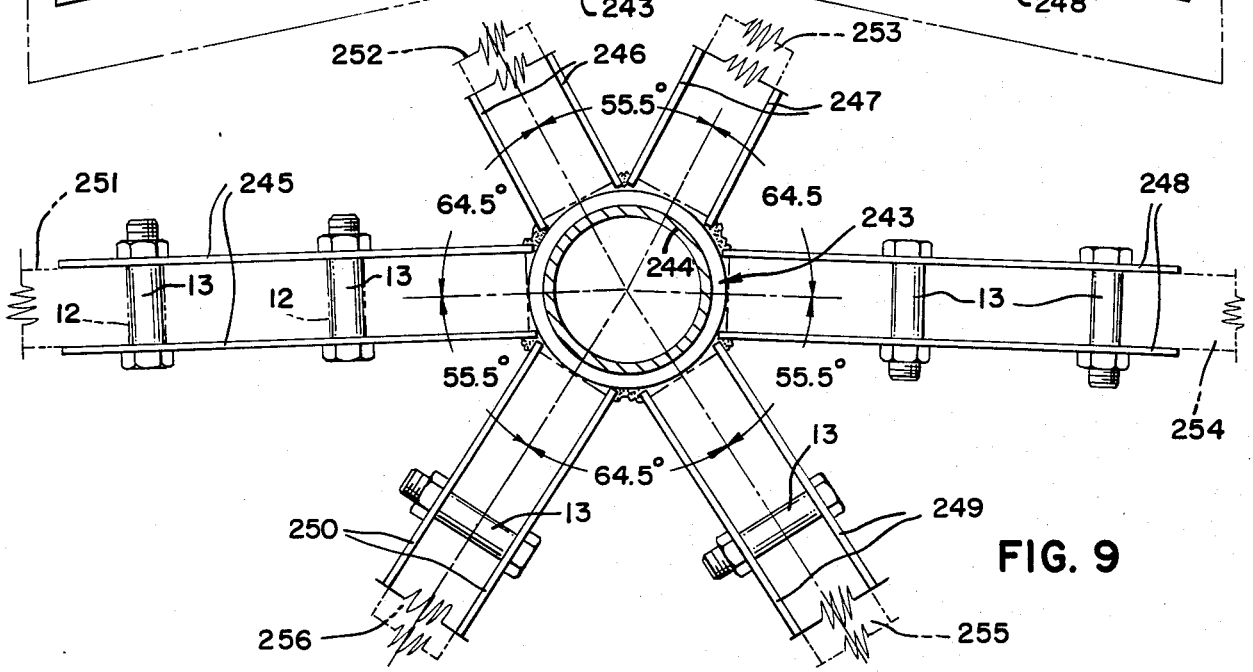
FIG. 9 is a cross sectional view taken along line 9—9 of FIG. 8.

In the preferred form of the connector illustrated in FIGS. 3, 8 and 9, the inside opening of the tubular hub is formed with internal threads 23 adapted for receiving an externally threaded metal tubular member 24.

Figure 2:
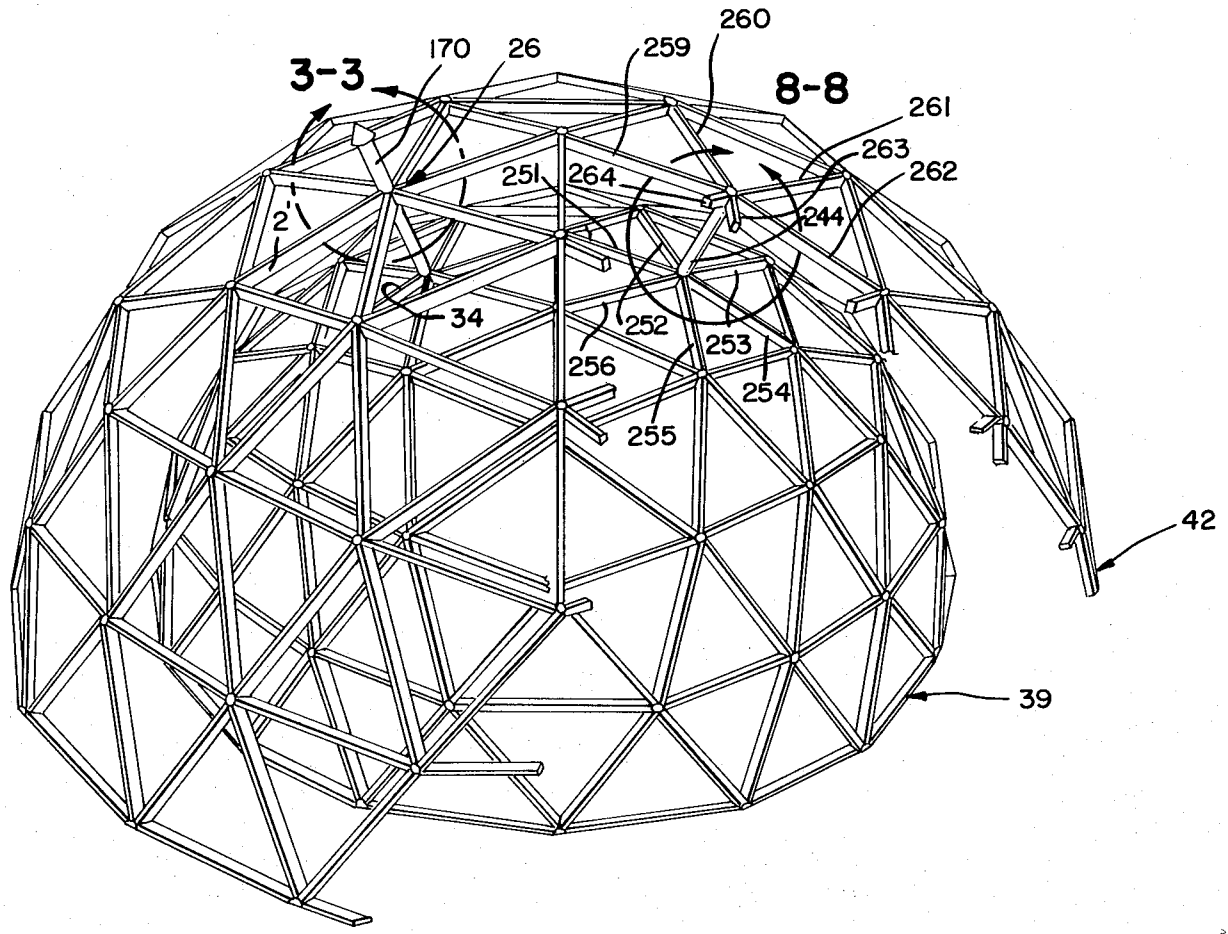
FIG. 2 is a perspective view of another application of the connector of the present invention. No connectors are illustrated. Reference numbers corresponding to connectors refer only to location of the respective connectors.

The prosivion of threaded hubs makes possible a unique structural system as applied to geodesic domes. As shown in FIGS. 2 and 3, the system comprises a pair of metal connectors 3' and 26 spaced from one another and each including internally threaded tubular hub members 4' and 27 and at least two pairs of circumferentially spaced support arms 5'-8' and 28-31. Each pair of arms is welded to the outside wall of the hub and extend radially outwardly therefrom parallel to one another at a pre-selected axial and radial angle and are formed with at least two pairs of radially spaced and aligned openings adapted for the receipt of wood structural members 2', 33, 34 and 35 therebetween. The struts are joined to the arms by fastening means 13 registering in the openings 12 and bore hold openings in the wood structural members. An elongated tubular member 24 formed with external threads 36 and 37 at each end which are adapted for threadable receipt within the internally threaded hubs of the spaced connectors 3' and 26.

FIGS. 1, 8 and 9 illustrate a slightly modified form of the invention shown in FIGS. 2 and 3 for joining an inner geodesic dome to an outer dome. Threaded hubs 242 and 243 are joined by pipe member 244. The lower hub is formed with six pairs of arms 245-250 joined to the outer surface of the hub as by welding. Struts 251-256 are joined to the straps by bolts 13 which register with bore holes in the struts. Similar arms as illustrated by arms 257 and 258 are welded to the upper hub 242. The arms of hub 242 connect struts 259-264. Note that the width of the straps may be considerably narrower than the struts.

FIG. 2 illustrates one of the many unique uses of the present connector system. A first geodesic dome 39 is constructed from a first series of metal connectors as illustrated by connector 243 and a first series of wood strut members as illustrated by wood strut 251. A second geodesic dome 42 is constructed from a second series of metal connectors as illustrated by connector 242 and a second series of wood strut members as illustrated by strut member 262 spaced from and substantially enveloping the first dome. The first and second series of metal connectors each are formed with a tubular internally threaded hub member and support arms connected to the hub which extend radially therefrom. A plurality of elongated tubular members as illustrated by pipe 244 are formed with external threads at their ends and are dimensioned for threadably connecting pairs of spaced metal connectors thereby structurally tying the first and second geodesic domes together.

Construction of the dome illustrated in FIG. 1 is as follows: First, strut members 45 are attached to a sill-board which rests on the foundation (not shown). The ends of the struts are connected to connectors 46, 47, and 48 which are similar to construction to connector 3 except that the hub members 49, 50 and 51 are cut and straight members 52, 53 and 54 are welded to the tubular hubs so as to rest upon the sill boards connected to the foundation.

Figure 13:
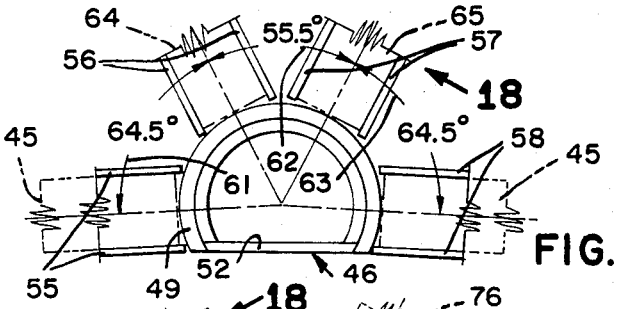
FIG. 13 is a plan view of a portion of the connector shown generally within line 13—13 of FIG. 1.

As illustrated in FIG. 13, hub 49 has four pairs of support arms 55–58 similar to support arms 5 and radially spaced at angles 61–63. Strut members 64 and 65 extend from the support arms.

Figure 14:
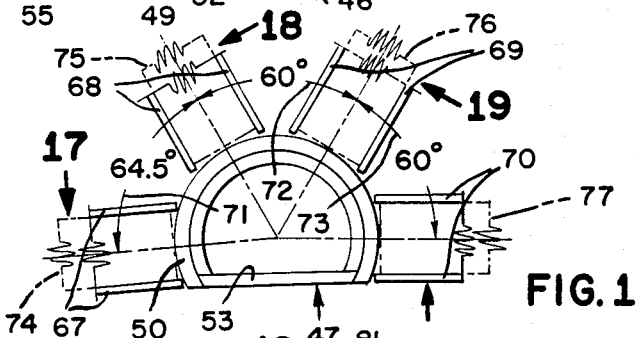
FIG. 14 is a plan view of a portion of the connector shown generally within line 14—14 of FIG. 1.

In FIG. 14, hub 50 has four pairs of support arms 67–70 radially spaced at slightly different angles 71–73. Strut members 74–77 extend from the support arms.

Figure 15:
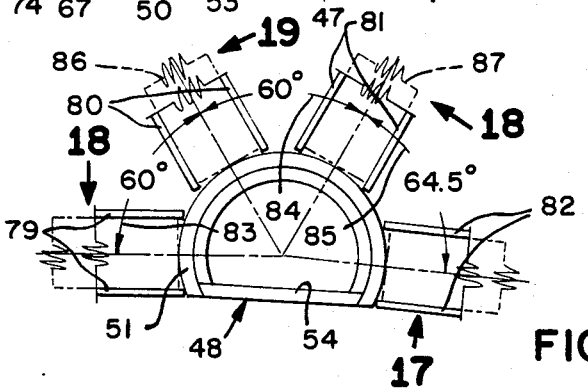
FIG. 15 is a plan view of a portion of the connector shown generally within line 15—15 of FIG. 1.

Finally, in FIG. 15, hub 51 also has four pairs of support arms 79–82 radially spaced at slightly different angles 83–85. Strut members 86 and 87 extend from the support arms.

FIG. 11 illustrates another modified connector similar to connector 3 and here indicated by the number 91. Five pairs of support arms 92–96 extend from hub 97 at angles 98–102. Strut members 103–107 extend from the support arms.

Figure 12:
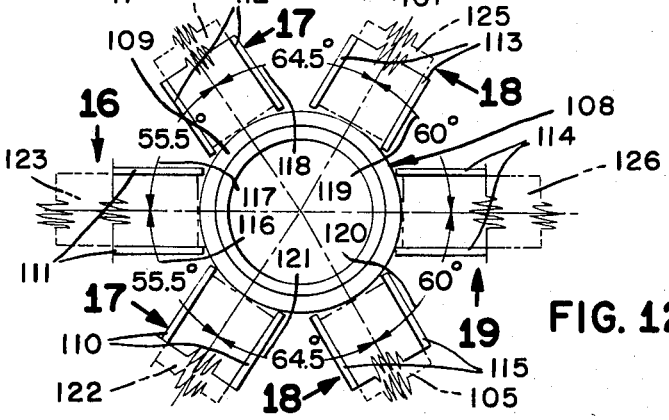
FIG. 12 is a plan view of a portion of the connector shown generally within line 12—12 of FIG. 1.

FIG. 12 illustrates connector 108. Six pairs of supports arms 110–115 extend from hub 109 at angles 116–121. Strut members 105 and 122–126 extend from the support arms.

The construction of the modified connector illustrated in FIGS. 1 and 4 and previously referred to is as follows. Pairs of support arms 5–8, 128, 129, 131 and 132 are attached to hub 4 as by welding and hold strut members 134–139. The struts are attached to the arms by bolts 13 which extend through bore holes in the struts in the usual manner. The smoke stack pipe 14 extends through the opening in hub 4 and the required distance beyond the roofing.

Figure 6:
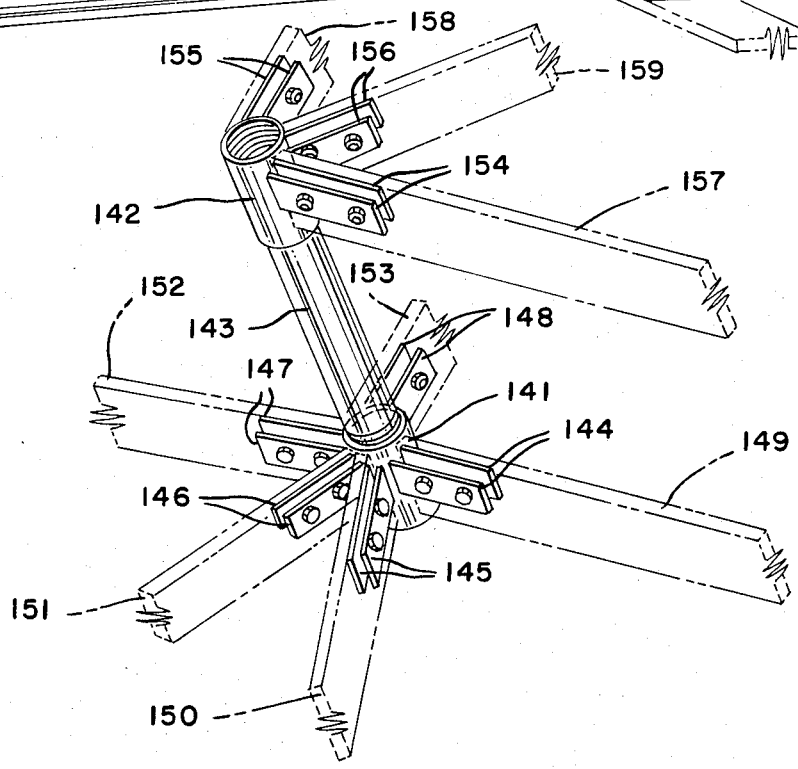
FIG. 6 is an enlarged perspective view of the connector of the present invention taken generally within the portion of the dome structure indicated by the lines 6—6 of FIG. 1.

The construction of a cupola for the purpose of adding windows, ventilation means or a loft is illustrated in FIGS. 1 and 6. Such a unique construction is made possible by the unique threaded hubs of the present invention. Specifically, threaded hubs 141 and 142 are joined by pipe member 143 which carries external threads at both ends. Hub 141 is formed with 5 pairs of support arms 144–148 which carry struts 149–153 which form a part of the main geodesic structure. Hub 142 is formed with three pairs of arms 154–156 which are connected to struts 157–159 which form the roof of the cupola. Connectors 160–163 complete the cupola corners with a connector 164 at the center completing the structure. Pipe members 165–168 join the hubs to the roof of the geodesic structure.

FIGS. 2 and 3 illustrate the construction of a double dome structure in which a vent pipe 170 extends through the hubs 27 and 4', through the pipe 24 and beyond the outer geodesic dome roof structure. Pairs of arms 28–31 and 171–174 are connected to hub 27 and are joined to struts 34, 35 and 175–178. The upper connector 3' includes pairs of arms 5'–8' and 181 and 184 which are attached to struts 2', 33 and 185–188.

Figure 5:
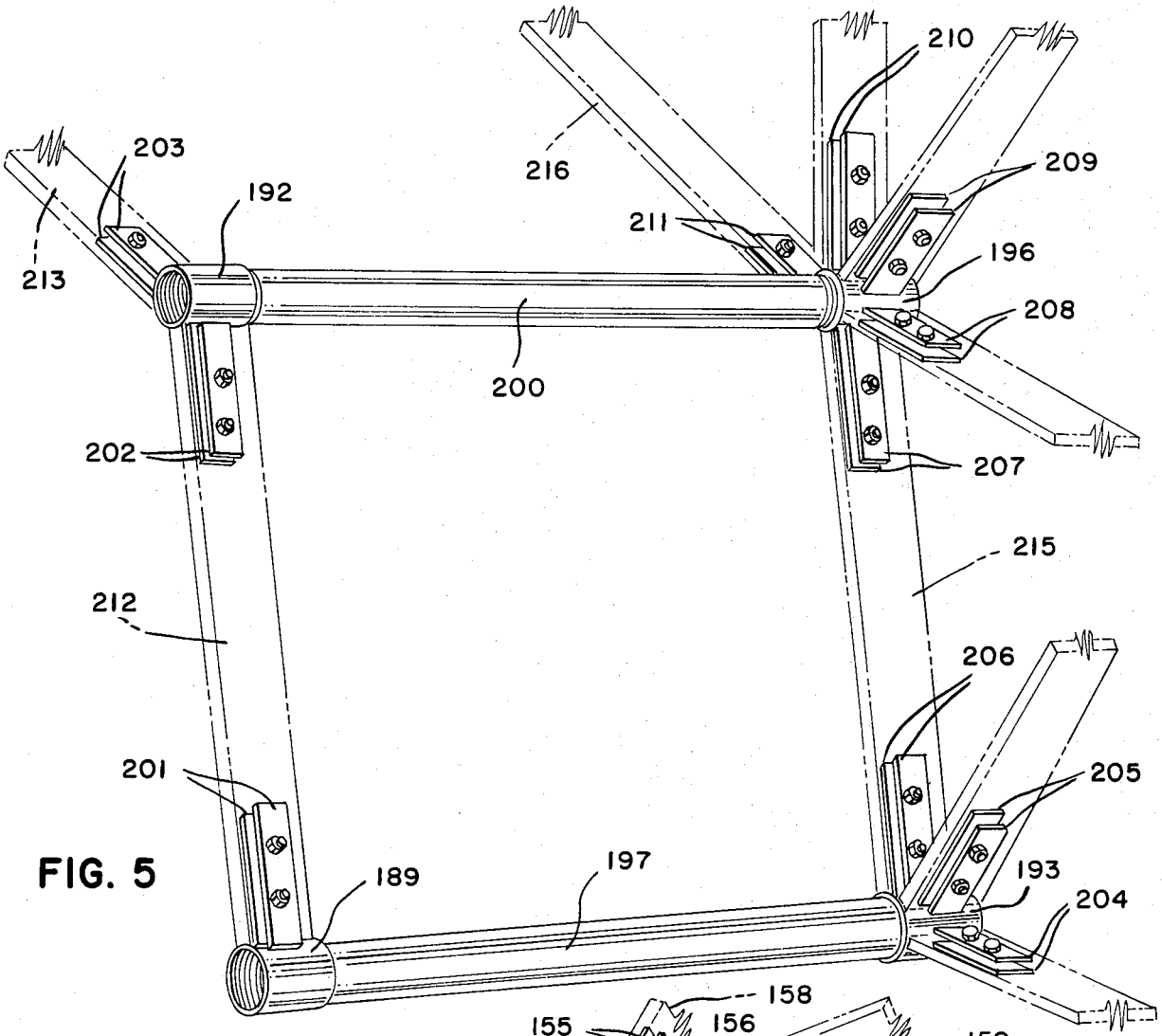
FIG. 5 is an enlarged perspective view of the connector of the present invention taken generally with the portion of the dome structure indicated by the lines 5—5 of FIG. 1.

FIGS. 1 and 5 illustrate the use of the connector of the present invention as used in the construction of doorways or structures connecting adjacent domes. Threaded hubs 189–192 are connected to threaded hubs 193–196 by pipe members 197–200. Hub 189 is formed with a pair of arms 201, hub 192 is formed with 2 pairs of arms 202 and 203, hub 193 is formed with three pairs of arms 204–206 and hub 196 is formed with five pairs of arms 207–201. Struts 212–214 joined to hubs 189–190 and struts 215–217 frame the doorway.

Figure 10:
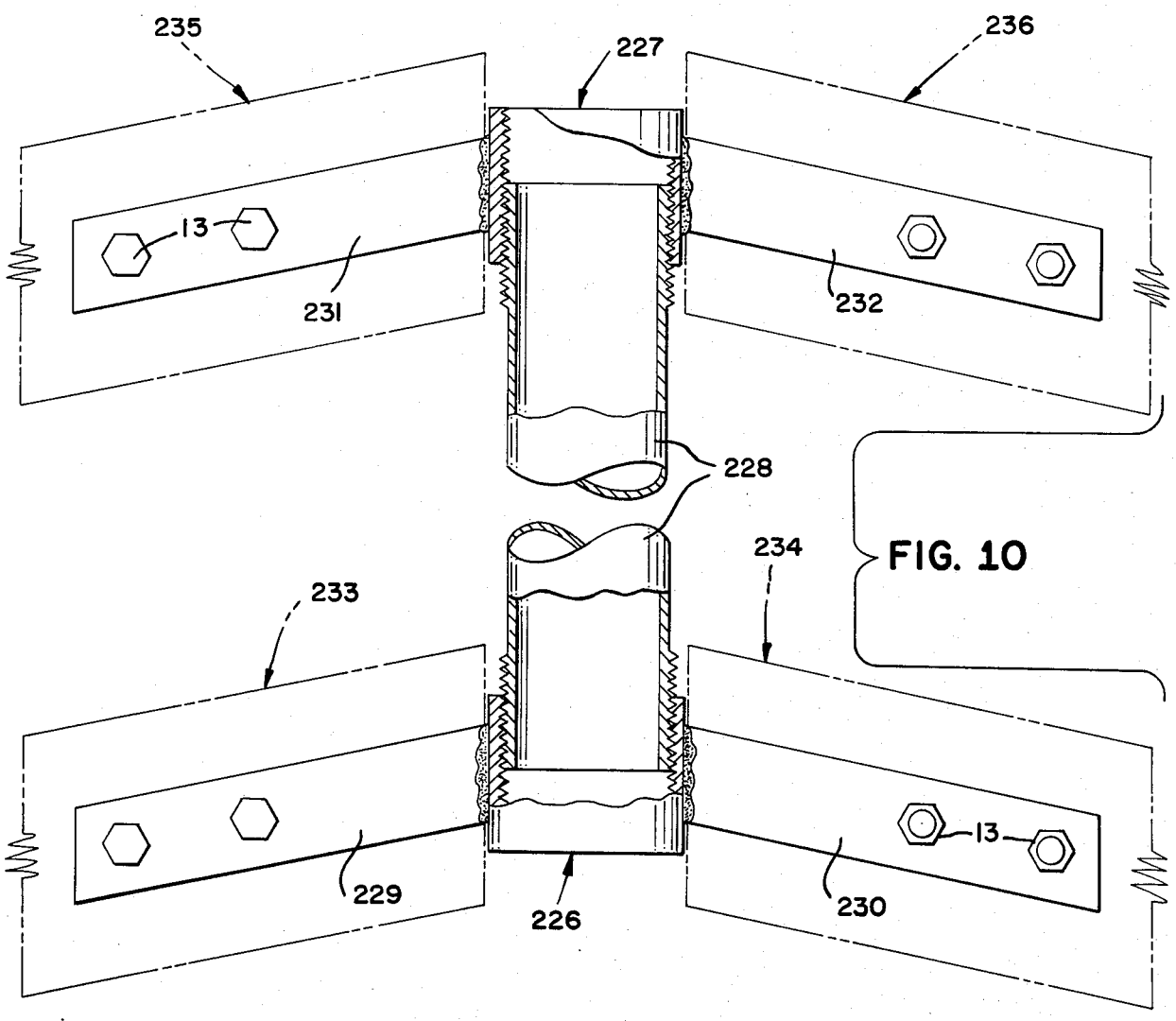
FIG. 10 is an enlarged cross sectional view, similar to the view illustrated in FIG. 8, but in a modified form of the invention.

FIG. 10 illustrates still another modified form of the invention. Threaded hubs 226 and 227 are threadably connected by pipe member 228 which is formed with external threads at both ends. Pairs of strap members 229–232 are joined to the hubs and hold struts 233–236. It is to be noted that the ends of the strut members extend above and below the respective hub members. Thus, the hub members can be dimensioned to provide bearing surface for substantially the entire end of the struts or only partially support the ends of the struts. As previously explained, if bearing strength is not required, the ends of the struts need not be cut to bear against the hubs.

I claim:

1. A metal connector for interconnecting wood structural members in a geodesic dome comprising:

a. a hub member including a wall having a central passage formed therethrough of substantially constant cross sectional area;

b. at least two pairs of circumferentially spaced support arms, each pair of arms being welded to the outside of said wall of said hub extending radially outwardly therefrom parallel to one another and at a pre-selected axial and radial angle and formed with at least two pairs of radially spaced and aligned openings and said pairs of arms being further adapted for the receipt of a wood structural member therebetween and joined to said arms by fastening means registering in said openings and openings in said wood structural member;

c. said inside opening of said tubular hub is formed with internal threads adapted for receiving an externally threaded metal tubular member; and d. said hub member is tubular in shape and said outside of said wall has a constant diameter.

2. A structural system for a geodesic dome for interconnecting wood structural members comprising:

a. a pair of metal connectors spaced from one another and each including:

(1) An internally threaded tubular hub member including a wall having a central passage formed therethrough of substantially constant cross sectional area, and (2) At least two pairs of circumferentially spaced support arms each pair of arms being welded to the outside of said wall of said hub and extending radially outwardly therefrom parallel to one another at a pre-selected axial and radial angle and formed with at least two pairs of radially spaced and aligned openings adapted for the receipt of a wood structural member therebetween and joined to said arms by fastening means registering in said openings and openings in said wood structural member; and b. an elongated tubular member formed with external threads at each end adapted for threadable receipt within said internally threaded hubs of said spaced connectors.

3. A building structure comprising:

a. a first geodesic dome constructed from a first series of metal connectors and a first series of wood strut members;

b. a second geodesic dome constructed from a second series of metal connectors and a second series of wood strut members forming a dome spaced from and substantially enveloping said first dome;

c. said first and second series of metal connectors each being formed with a tubular internally threaded hub member including a wall having a central passage formed therethrough of substantially constant cross sectional area and support arms connected to said hub and extending radially therefrom; and d. a plurality of elongated tubular members formed with external threads at their ends dimensioned for threadably connecting pairs of said spaced metal connectors thereby structurally tying said first and second geodesic domes together.

* * * * *